US005100296A

United States Patent [19]

Partington et al.

[11] Patent Number: 5,100,296

[45] Date of Patent: Mar. 31, 1992

[54] STEAM TURBINE INTEGRAL CONTROL STAGE BLADE GROUP

[75] Inventors: Albert J. Partington; Martin E. Schlatter, both of Winter Springs, Fla.

[73] Assignee: Westinghouse Electric Corp., Pittsburgh, Pa.

[21] Appl. No.: 506,147

[22] Filed: Apr. 9, 1990

[51] Int. Cl.[5] ..... F01D 5/26

[52] U.S. Cl. ..... 416/217; 416/204 A

[58] Field of Search ..... 416/204 A, 217

[56] References Cited

U.S. PATENT DOCUMENTS

| | | | |
|---|---|---|---|
| 1,345,642 | 7/1920 | Schmidt | 416/217 |
| 2,326,145 | 8/1943 | Kroon | 416/217 |
| 4,135,849 | 1/1979 | Pigott | 416/217 |
| 4,321,012 | 3/1982 | Tan et al. | 416/217 |
| 4,460,316 | 7/1984 | Partington | 416/217 |

FOREIGN PATENT DOCUMENTS

| | | | |
|---|---|---|---|
| 32201 | 2/1987 | Japan | 416/219 R |

*Primary Examiner*—John T. Kwon

[57] ABSTRACT

An integral control stage blade group for use in a steam turbine having a rotor, the rotor including radially extending flanges provided with opened and smooth faces defining at least one pair of spaced annular grooves. The blade group comprises a plurality of blades attached to a unitary platform. Secondly, the blade group comprises a plurality of root portions depending from the platform in a direction opposite from the blades. The root portions extend along the platform in a circumferential direction when said blade group is mounted on the rotor. Each of the root portions fits within a respective one of the annular grooves in the rotor. Finally, the blade group comprises at least three spaced apertures formed in said root portion and arranged to align with corresponding apertures in the rotor flanges when the blade group is mounted on the rotor. Each aperture is formed so as to lie on a common rotor circumference and to extend parallel to an axis of the rotor for receiving a pin through the aligned apertures to fasten the blade group to the rotor.

6 Claims, 2 Drawing Sheets

STEAM TURBINE INTEGRAL CONTROL STAGE BLADE GROUP

This invention relates to turbine blading and, more particularly, to attachment of turbine blading to a turbine rotor.

BACKGROUND OF THE INVENTION

In U.S. Pat. No. 2,326,145 issued in 1943, it was proposed to fasten segmental blade groups to turbine rotors by two transverse pins extending through openings provided in or near to the end faces of the root portion of the blade group. During use, it was found that this arrangement of root fastening suffered from metal creep, i.e., the metal in the blade root tended to flow around the two pins and the concentrated pin forces resulted in bulging of the rotor surface In order to alleviate the creep problem, the fastening arrangement was modified by extending the depth of the root portion sufficiently to allow a third pin to be inserted. The third pin was positioned below the diameter of the original two pins so that a triangular arrangement of pins was created. This form of blade groups attachment has been in use for at least thirty years.

While the three pin fastening arrangement has been generally satisfactory, it is desirable to improve the vibratory strength of such segmental blade groups and to simplify the assembly of the groups to a turbine rotor. For example, the prior art blade groups generally incorporated three blades in a group with three fastening pins. This generally necessitated smaller pins and correspondingly smaller diameter holes in the blade root and rotor flanges. With holes in the order of one-half inch in diameter, it is difficult to maintain an exact hole when the hole is drilled through three flanges on the blade root and four flanges on the rotor, i.e., it is not uncommon for a drill bit to wander slightly when drilling extended holes. This action may create pin fit problems as well as detrimentally affecting loading on the pin. Still further, with off-set pins, i.e., at different radial distances from the rotor, thermal expansion at the outer pins is greater than the inner pin thus placing more load on the inner pin. Since the centrifugal loading on a blade group may be as much as 100,000 pounds, uneven loading on the pins may lead to shorter service life.

SUMMARY OF THE INVENTION

Among the several objects of the present invention is the provision of a segmental blade group fastening arrangement for attaching blade groups to a turbine rotor which overcomes the above and other disadvantages of the prior art; the provision of a fastening arrangement which increases the strength of the prior art segmental blade groups; the provision of a fastening arrangement which eliminates the prior art use of one pin per blade; the provision of larger diameter pins with correspondingly larger holes which are more easily aligned; and the provision of all fastening pins on a common diameter of the rotor.

In one form, the present invention is illustrated as comprising an extended arc segmental blade group for a steam turbine in which the blade group includes at least six blades per group and is fastened to a turbine rotor using at least three large diameter pins all oriented along a common circumference of the rotor. Applicants have found that the vibratory strength characteristic of the prior fastening arrangement can be increased substantially by extending the segmental blade group to encompass a rotor arc of more than three blades. This arrangement allows for the use of larger diameter pins for attaching the blade group to the rotor and further permits spacing of the pins such that stresses at each pin are not spread to adjacent pins. The larger pins provide a lower stress concentration factor for a given blade group length. Further, by extending the blade group arc, a smaller number of pins is required for a blade row thus providing a substantial cost and pin installation accuracy advantage.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
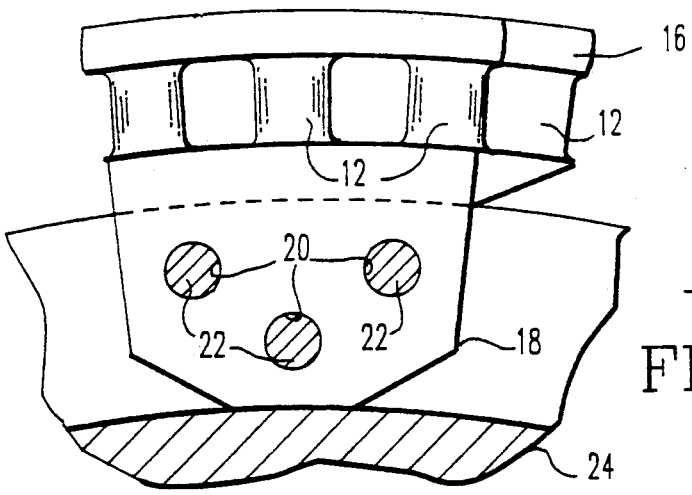
PRIOR ART FIG. 1
FIG. 1 illustrates a segmental blade group with non-aligned pin attachments typical of the prior art.
Figure 2:
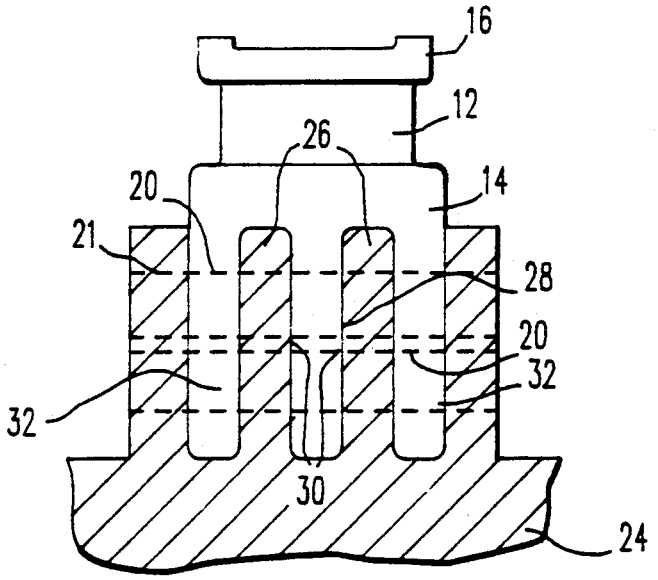
PRIOR ART FIG. 2
FIG. 2 is an edge view of the blade group of FIG. 1.

Referring to FIGS. 1 and 2, the prior art segmental blade group 10 typically includes three blades or airfoils 12 connected to a common platform 14 and an integral shroud 16. A root portion 18 extends from the platform 14 and includes three apertures or holes 20 arranged in a triangular configuration. Pins 22 are inserted in each of the holes 20 for fastening the blade group to a rotor 24. The rotor 24 includes circumferential grooves 28 defined by flanges 26 with the flanges having holes which align with the holes 20 to allow passage of the pins 22. The flanges 26 have flat, parallel sidewalls 30 such that the flanges 32 of root portion 18 fit snugly within the grooves 28.

The prior art arrangement of FIGS. 1 and 2 has been a successful fastening arrangement since it provides a tight root fit, high structural rigidity, high natural frequency, high damping, and requires no riveting. However, these properties can be substantially improved further by extending the blade group in the circumferential direction and increasing the pin diameter. In the prior art, the size of the blade group, typically three blades, necessitates the use of small diameter pins 22, e.g., pins having a diameter of about 0.6 inches. Smaller pins cause a higher stress concentration and places more stress on the blade root and rotor. Furthermore, with the pins located at different diameters from the rotor axis, thermal growth tends to unload the outer pins more than the inner pin thereby transferring more load to the inner pin.

Applicants have found that the creep problem associated with the prior art two pin fastening arrangement, which problem led to the three pin triangular fastening arrangement, can be obviated by an in-line multi-pin fastening arrangement using more than two pins. Furthermore, Applicants have found that the shock load amplification factor for partialarc operation decreases as the number of blades per group increases. Thus, it is desirable to form segmental blade groups having more than three blades. With larger blade groups, a larger diameter pin (for a given root depth) can be used resulting in a lower stress concentration factor for a given blade group length. By spacing the pins farther apart on a longer blade group, the pin vibratory forces and blade and rotor stresses are reduced. When the pins are on one rotor diameter, there is a greater radial distance between the edge of the pins and the edges of the rotor and blade root for a given rotor groove depth. Reducing the number of pins per row by using, for example, three pins for a segmental blade group of six blades results in a significant cost savings. Since the thermal coefficient for the pin material is different from the coefficient of the blade and rotor materials, a larger pin size facilitates a tight fit under operating conditions. The tight fit is very important since the blade group is subjected to partial admission shock forces which may be as high as 6000 pounds and occur sixty times per second. Furthermore, the larger pin allows use of a larger drill bit which is much less susceptible to wander or deviate from a proscribed path when drilling through multiple flanges.

Figure 3:
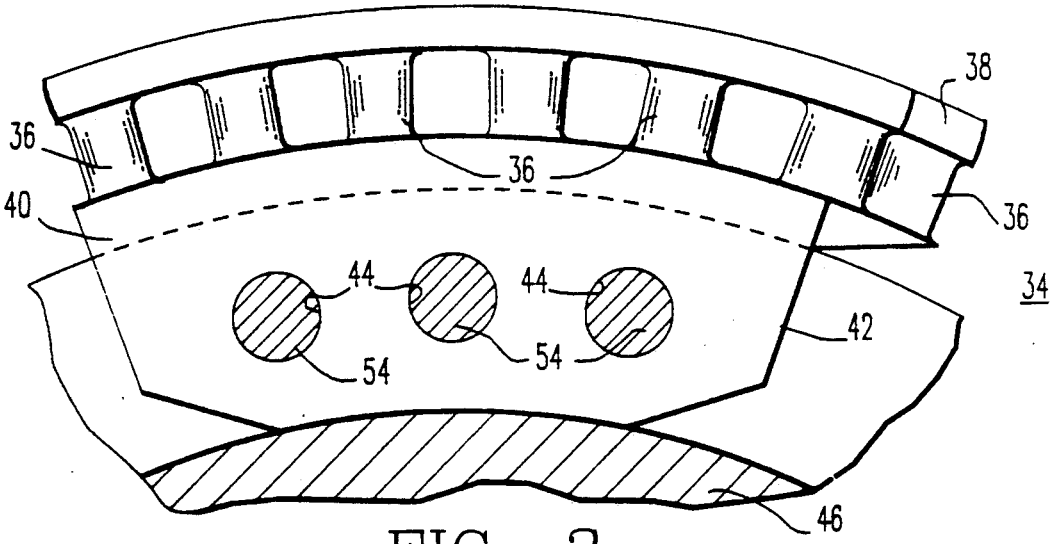
FIG. 3 illustrates an extended arc blade group in accordance with one form of the present invention.
Figure 4:
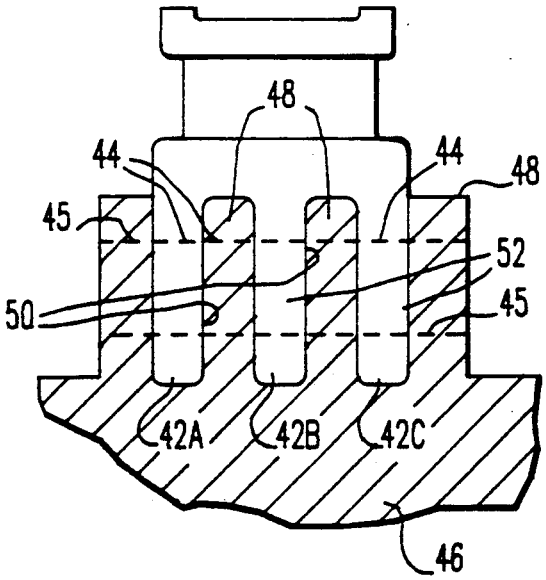
FIG. 4 is an edge view of the blade group of FIG. 3.

Turning now to FIGS. 3 and 4, there is shown a segmental blade group 34 in accordance with one form of the present invention. Blade group 34 includes a number of blades 36 greater than three and preferably six. The blades 36 extend between an outer blade shroud 38 and an inner platform 40. A blade root 42 extends radially inwardly of the platform 40. Within the root 42, there is a plurality of apertures 44, preferably three, all aligned on an equal diameter or common circumference of rotor 46. The blade root 42 is preferably a triple flange root as shown in FIG. 4 having three flanges 42A, 42B, and 42C. The rotor 46 includes at least two circumferential and radially extending flanges 48. The flanges 42A, 42B, and 42C of roots 42 fit snugly in the grooves 50 defined between the flanges 48 which, in turn, define the grooves 52 for receiving the root flanges 42A–C. The flanges 48 and 42A–C all have flat, parallel side faces for providing maximal contact between the flanges. In general, it is desirable to have four flanges on the rotor and three flanges on the blade group. The rotor flanges include apertures 45 which align with apertures 44 when the blade group is assembled to the rotor. Pins 54 extend through the apertures 44, 45 to couple the blade group to the rotor. The pins 54 are press fit in the aligned apertures.

The extended arc blade group of FIG. 3 is of sufficient length to permit use of larger pins 54 for holding the blade group to the rotor. The pins may be, for example, 0.9 inch in diameter. The spacing between pins 54 may be greater than the pin diameter due to the extended arc group. Further, the radially inner corners 56 of the root 42 may be chamfered or removed without structurally weakening the root. This permits for an additional weight reduction.

Figure 5:
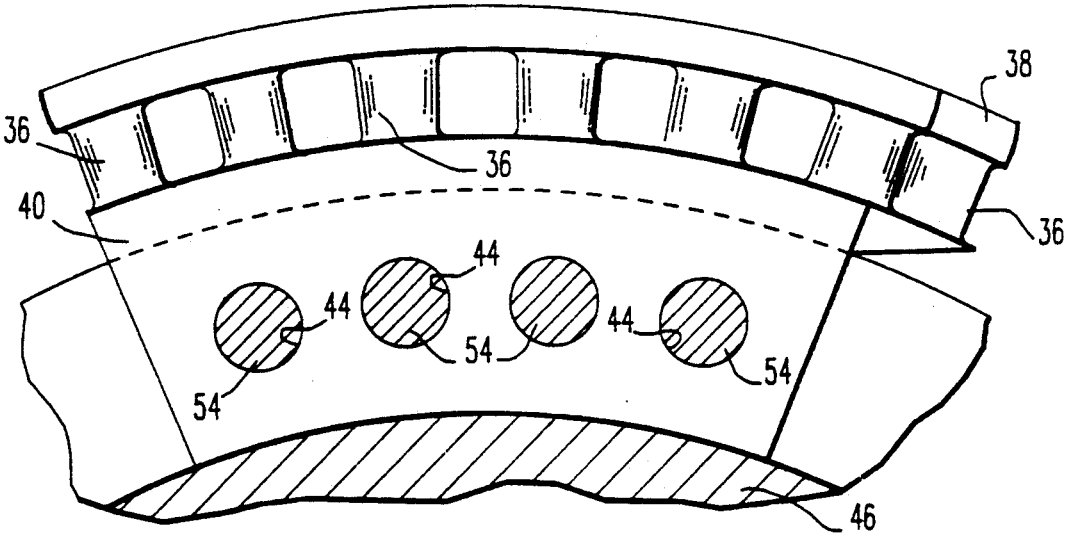
FIG. 5 illustrates another form of the present invention with a modified root portion to allow use of more than three pins.

FIG. 5 illustrates an alternative arrangement of the blade group of FIG. 3 in which four pins 54 are used to fasten the blade group to the rotor. Even with the additional pin, the longer length of the blade group allows use of the larger pin 54 while still maintaining sufficient space between pins to alleviate stress transfer between pins. In either the embodiment of FIGS. 3 or 5, the pins 54 are on a common diameter with respect to the rotor axis so that thermal growth is uniform and each pin supports the blade group. Furthermore, the pins 54 are produced from material having a higher thermal coefficient than the blade root and rotor material so that tight contact is maintained about the pins when operating temperatures reach as high as 1000° F.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the claims which follow.

What is claimed is:

1. An integral control stage blade group for use in a steam turbine, the turbine including a rotor having radial flanges provided with opposed and smooth faces defining a plurality of spaced annular grooves, the blade group comprising:

a plurality of blades attached to a unitary platform;

a plurality of root portions depending from said platform in a direction opposite from said blades, said root portions extending along said platform in a circumferential direction when said blade group is mounted on the rotor, each of said root portions fitting within a respective one of the annular grooves in the rotor; and at least three spaced apertures formed in said root portion and arranged to align with corresponding apertures in the rotor flanges when the blade group is mounted on the rotor, each aperture being formed so as to lie on a common rotor circumference and to extend parallel to an axis of the rotor for receiving a pin through the aligned apertures to fasten the blade group to the rotor, each pin being formed of a material having a higher coefficient of thermal expansion than the material of the rotor and the blade root whereby a tight fit is maintained about the pins at turbine operating temperatures.

2. The integral control stage blade group of claim 1 wherein said plurality of blades includes at least six blades.

3. The integral control stage blade group of claim 1 wherein said apertures are spaced sufficiently far apart circumferentially such that stress transmitted to the root portions from each pin does not interact with stress transmitted from an adjacent pin.

4. The integral control stage blade group of claim 1 wherein each aperture is sized to receive a pin of approximately 0.9 inch diameter.

5. The integral control stage blade group of claim 1 wherein said root portion is formed with four spaced apertures for receiving four pins.

6. The integral control stage blade group of claim 1 wherein the radially inner end of said root portion is formed with chamfered corners.

* * * * *